US009524859B2

(12) United States Patent
Lin et al.

(10) Patent No.: US 9,524,859 B2
(45) Date of Patent: Dec. 20, 2016

(54) PULSED ION BEAM SOURCE FOR ELECTROSPRAY MASS SPECTROMETRY

(71) Applicant: Academia Sinica, Taipei (TW)

(72) Inventors: Jung-Lee Lin, Taipei (TW); Chung-Hsuan Chen, Taipei (TW); Chen-Yu Hsieh, Taipei (TW)

(73) Assignee: Academic Sinica, Taipei (TW)

( * ) Notice: Subject to any disclaimer, the term of this patent is extended or adjusted under 35 U.S.C. 154(b) by 273 days.

(21) Appl. No.: 14/450,267

(22) Filed: Aug. 3, 2014

(65) Prior Publication Data

US 2015/0136973 A1 May 21, 2015

Related U.S. Application Data

(60) Provisional application No. 61/862,046, filed on Aug. 4, 2013.

(51) Int. Cl.
*H01J 49/16* (2006.01)
*H01J 49/04* (2006.01)

(52) U.S. Cl.
CPC ..... *H01J 49/165* (2013.01); *H01J 49/0495* (2013.01)

(58) Field of Classification Search
USPC ..... 250/288, 281, 282
See application file for complete search history.

(56) References Cited

U.S. PATENT DOCUMENTS 6,641,783 B1 * 11/2003 Pidgeon ..... G01N 30/20 210/656
6,828,550 B2 * 12/2004 Griffey ..... H01J 49/0077 250/281
2003/0106996 A1 * 6/2003 Covey ..... H01J 49/067 250/288
2014/0217279 A1 * 8/2014 Kenny ..... H01J 49/067 250/283

* cited by examiner

*Primary Examiner* — Kiet T Nguyen
(74) *Attorney, Agent, or Firm* — Eckman Basu LLP

(57) ABSTRACT

Apparatus and methods for creating a pulsed ion beam. The pulsed ion beam can be used for performing mass spectrometry. A pulsed solenoid valve can provide a pulsed ion beam from an electrospray in a pre-vacuum chamber. The pulsed ion beam can enter a high vacuum region and a mass analyzer for mass spectrometry.

20 Claims, 6 Drawing Sheets

PULSED ION BEAM SOURCE FOR ELECTROSPRAY MASS SPECTROMETRY

BACKGROUND OF THE INVENTION

Electrospray ionization (ESI) has been useful to study nonvolatile, thermally-labile organic and/or biomolecules by mass spectrometry. In general, ESI is carried out at ambient atmospheric pressure.

ESI sources can be viewed as providing direct ionization, such as by nanospray that reduces flow rate and capillary size, or by subambient pressure ionization with nanoelectrospray (SPIN), or by pneumatic pressure ionization such as sonic spray ionization (SSI).

ESI sources can also be viewed as providing post-ionization, i.e. ionization after desorption.

In general, ESI requires ion transport through an interface into a vacuum region where a mass analyzer and detector can be located. The interface may be a capillary tube at atmospheric pressure.

To maintain high throughput of the analyte gas, the vacuum region must be maintained at high vacuum. Thus, an electrospray mass spectrometer can have large pumps with high pumping speed. Typically, a rough pump and a turbo pump are used.

A drawback in this arrangement can be heavy air loading of the turbo pump and loss of high vacuum. In general, this means that a relatively larger pump must be used to achieve a given vacuum and certain transport characteristics in an electrospray mass spectrometer.

For example, conventional mass spectrometers may have two large throughput mechanical rotary vane pumps, as well as a large capacity turbo pump with multiple pumping stages, or multiple turbo pumps. Such instruments can have a mass of over 100 kg.

Another drawback is that to reduce the amount of gas loading in the system, it would be necessarily to reduce the throughput of analyte gas. This can greatly reduce the sensitivity of the instrument.

These drawbacks make it difficult to use ESI efficiently at low pressures or to inject analytes directly into a mass analyzer of a mass spectrometer using ESI.

There is a continuing need for a means to reduce the amount of gas loading required in an electrospray mass spectrometer so that the size of the pumping apparatus can be reduced.

There is also a need for a mass spectrometer that can inject ions by electrospray directly into a high vacuum region of a mass spectrometer to reach a mass analyzer.

BRIEF SUMMARY

This invention relates to the fields of pulsed ion beams and mass spectrometry. More particularly, this invention relates to methods and devices for generating a pulsed ion beam, and for generating and utilizing a pulsed ion beam for mass spectrometry. In particular, this invention relates to an apparatus and methods for utilizing a pulsed ion beam in electrospray mass spectrometry.

Embodiments of this invention include the following:

A method for obtaining a mass spectrum, the method comprising:

providing analyte ions from an electrospray tip in a pre-vacuum chamber having an orifice;

operating a pulsed solenoid valve attached to the pre-vacuum chamber by opening and closing the orifice with a conductive tip of a poppet of the pulsed solenoid valve, thereby providing a pulsed analyte ion beam comprising pulses of analyte ions exiting the pre-vacuum chamber through the orifice and entering a high vacuum region containing a mass analyzer, wherein when the orifice is opened the pre-vacuum chamber is in fluid communication with the high vacuum region and the build up of electrical charges on the poppet and orifice are avoided;

operating the mass analyzer to collect the analyte ions in the pulsed analyte ion beam and separate the analyte ions by their mass to charge ratio;

detecting the separated analyte ions.

The method above, wherein more than one pulse of the pulsed analyte ion beam is collected and separated by the mass analyzer.

The method above, wherein the duration of the pulsed analyte ion beam is controlled by using a delay time function generator.

The method above, wherein the analyte ions are formed from nonvolatile, thermally-labile organic molecules or biomolecules.

The method above, further comprising heating the pre-vacuum chamber to a temperature of up to 130° C.

The method above, further comprising heating the pre-vacuum chamber to a temperature of up to 105° C.

A mass spectrometer apparatus comprising:

a high vacuum region containing a mass analyzer, wherein the pressure in the high vacuum region is maintained by pumps;

a pre-vacuum chamber having an orifice formed by a wall of the pre-vacuum chamber;

an electrospray tip in the pre-vacuum chamber;

a pulsed solenoid valve attached to the pre-vacuum chamber that seals the orifice when the valve is closed, wherein the orifice provides fluid communication between the pre-vacuum chamber and the high vacuum region when the pulsed solenoid valve is opened;

a detector.

The apparatus above, wherein the pulsed solenoid valve has a poppet with a conductive tip, wherein the tip of the poppet is arranged to close the orifice.

The apparatus above, wherein the conductive tip is formed from a conductive rubber or conductive plastic.

The apparatus above, wherein the pulsed solenoid valve has a response time of less than 2 ms.

The apparatus above, wherein the wall of the pre-vacuum chamber containing the orifice is integrated with the mass analyzer.

The apparatus above, wherein the mass analyzer is an ion trap.

The apparatus above, wherein the mass analyzer is a quadrupole ion trap.

The apparatus above, wherein the duration of the pulsed ion beam is controlled by using a delay time function generator.

The apparatus above, wherein the mass of the pumps is less than about 6 kg.

The apparatus above, wherein the mass of the apparatus is less than 40 kg.

An apparatus for creating a pulsed ion beam, the apparatus comprising:

a pre-vacuum chamber;

an orifice formed by a wall of the pre-vacuum chamber;

a pulsed solenoid valve attached to the pre-vacuum chamber;

a poppet of the pulsed solenoid valve having a tip, wherein the tip of the poppet is formed of conductive rubber and seals the orifice when the valve is closed, and wherein the pulsed solenoid valve can be opened by pulling the poppet back from the orifice.

The apparatus above, wherein the pulsed solenoid valve has a response time of less than 2 ms.

The apparatus above, wherein the duration of the pulsed ion beam is controlled by a delay time function generator to operate the pulsed solenoid valve.

The apparatus above, wherein the pre-vacuum chamber is heated.

BRIEF DESCRIPTION OF THE DRAWINGS

FIG. 3 shows that while a trapping voltage is being applied to the mass analyzer and the ion trapping process is active, a voltage can be applied to the pulsed solenoid valve for a duration period and at a rate to open the pulsed solenoid valve a number of times for the acquisition of a mass spectrum.

FIG. 4 shows the very low signal obtained when the pulsed solenoid valve was closed and no ions were allowed to pass.

FIG. 5 shows the mass spectrum obtained when the pulsed solenoid valve was triggered at a rate of 1 Hz.

FIG. 6 shows the mass spectrum obtained for the same conditions as in FIG. 5, and when the pulsed solenoid valve was triggered at a rate of 10 Hz. The analyte ion mass spectrum intensity increased by ten times when the repetition rate of the pulsed valve was increased by a factor of ten.

DETAILED DESCRIPTION OF THE INVENTION

Figure 1:
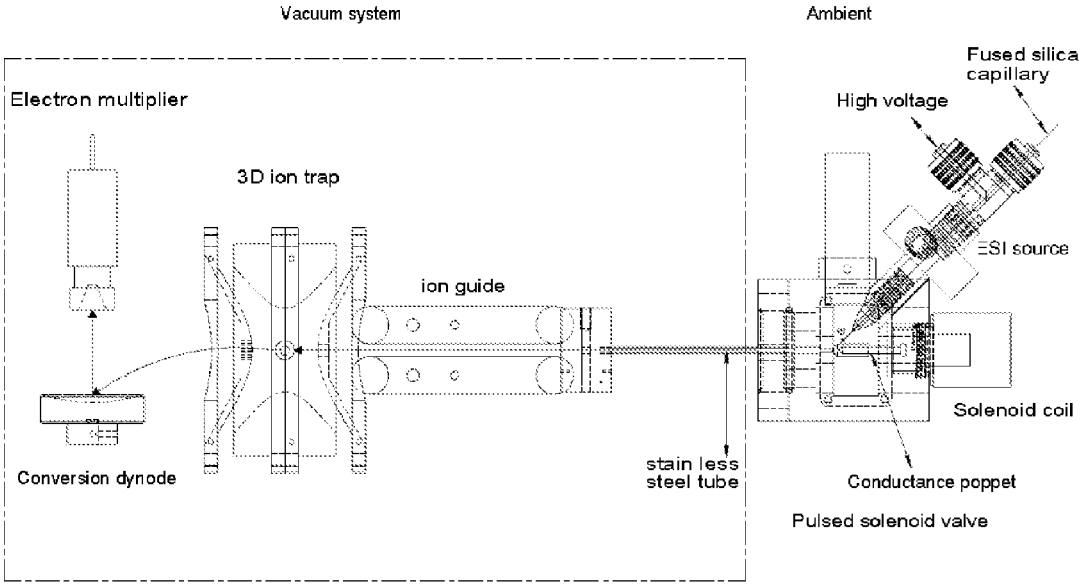
FIG. 1 shows a schematic of an embodiment of a pulsed ion beam electrospray mass spectrometer of this invention. A mass analyzer such as a 3D ion trap is located within the high vacuum region of the mass spectrometer. To introduce analyte ions into a mass analyzer in a high vacuum region, a pulsed ion beam is created using a pulsed solenoid valve apparatus attached to a pre-vacuum chamber which is adjacent to the high vacuum region. An electrospray apparatus is used having an electrospray tip inserted directly into the interior of the pre-vacuum chamber. The pulsed ion beam travels through a tube and ion guide in the high vacuum region to a mass analyzer.

Embodiments of this invention provide apparatuses and methods for creating pulsed ion beams. The pulsed ion beams of this invention can be used in mass spectrometry.

In some embodiments, this invention can provide a pulsed solenoid valve apparatus to control the total amount of gas ions entering a high vacuum region from a region having a higher pressure.

The pulsed solenoid valve apparatus of this disclosure can reduce the pumping speeds required to maintain the high vacuum region at high vacuum without sacrificing or reducing the throughput of the gas ions. The reduction in pumping speeds can be achieved with high transmission efficiency of the gas ions or analyte ions.

In certain embodiments, this invention provides an apparatus for efficient electrospray ionization mass spectrometry that requires much smaller pumps than conventional mass spectrometers. By reducing the amount of gas loading required in an electrospray mass spectrometer, the size of the pumping apparatus can be reduced.

Embodiments of this invention provide apparatuses and methods for creating pulsed ion beams that can permit direct injection of analyte ions into a high vacuum region of a mass spectrometer to reach a mass analyzer.

In certain aspects, an apparatus of this invention can be used to create a pulsed ion beam and modulate and control the rate of entry of analyte ions in the pulsed ion beam into a mass analyzer of a mass spectrometer.

A pulsed ion beam apparatus of this invention can provide a surprisingly high throughput of gas ions into a high vacuum region from a region having a higher pressure.

In some aspects, a pulsed ion beam apparatus of this invention can remove barriers to the transport of gas ions into a high vacuum region from a region having a higher pressure. By removing the barriers to the transport of gas ions, a pulsed ion beam apparatus of this invention can provide a surprisingly high density of gas ions in the pulsed ion beam.

In further aspects, a pulsed ion beam apparatus of this invention can be used to provide an efficient pulsed ion beam electrospray ionization source for a mass spectrometer for studies in chemistry, biochemistry, medicine, environmental protection, and analysis of food industry components, among other things.

For example, this invention can provide methods and apparatuses for mass spectrometry of nonvolatile, thermally-labile organic and/or biomolecules.

The apparatus and methods of this disclosure can be used with an electrospray ionization (ESI) source for direct ionizations such as nanospray that reduces flow rate and capillary size.

Further, the apparatus and methods of this disclosure can be used with subambient pressure ionization with nanoelectrospray (SPIN).

In some embodiments, the apparatus and methods of this disclosure can be used with pneumatic pressure ionization such as sonic spray ionization (SSI).

In additional embodiments, the apparatus and methods of this disclosure can be used with methods for post-desorption ionization including ionization by SSI laser photon, heat, acoustic shock, and irradiation with radio frequency.

The arrangement and operation of an embodiment of an apparatus of this invention for creating pulsed ion beams, especially for use in electrospray mass spectrometry are described below.

In general, mass spectrometry can be used to measure the mass-to-charge ratio (m/z) of a particle such as an atom, a molecule, a particle or a cluster. For an atomic ion or a small molecular ion, the number of charges (z) is often equal to 1, so that the mass-to-charge ratio (m/z) is the same as m.

FIG. 1 shows a schematic of an embodiment of a pulsed ion beam electrospray mass spectrometer of this invention. A mass analyzer such as a 3D ion trap is located within the high vacuum region of the mass spectrometer. To introduce analyte ions into a mass analyzer in a high vacuum region, a pulsed ion beam is created using a pulsed solenoid valve apparatus attached to a pre-vacuum chamber which is adjacent to the high vacuum region. An electrospray apparatus is used having an electrospray tip inserted directly into the interior of the pre-vacuum chamber. The pulsed solenoid valve is used to provide a pulsed ion beam for delivery into the mass analyzer of the mass spectrometer. The pulsed ion beam can be delivered into the mass analyzer through a stainless steel tube and/or an ion guide.

In some embodiments, the electrospray tip is inserted directly into the pre-vacuum chamber of the pulsed solenoid valve.

In operation, ions can be continuously fed into the pre-vacuum chamber of the pulsed solenoid valve by the electrospray.

In operation, the pressure in the pre-vacuum chamber can be about 1 atmosphere (1 atm). The pressure in the pre-vacuum chamber can vary above and below 1 atm, in relation to the flow from the electrospray tip and the rate of exit through the pulsed valve.

In some embodiments, a positive pressure, greater than 1 atm, can be applied in the chamber, which advantageously increases desolvation during the ESI process. However, the greater pressure can allow more air into the ion trap, which may interfere with the ion trajectory and reduce resolution.

In some embodiments, a negative pressure, less than 1 atm, can be applied in the chamber, which advantageously reduces the amount of air entering the vacuum region and interfering with the ion trap performance. The number of ions entering the ion trap may be slightly reduced because of the reduced pressure difference between the ion trap and the pre-vacuum chamber.

On balance, a slight negative pressure in the pre-vacuum chamber can provide surprisingly good resolution and signal level.

Analytes can be introduced into the electrospray capillary by syringe injection using a syringe pump. In operation, pressure can be applied to the analytes by the syringe pump and high voltage can be applied to the electrospray tip to create analyte ions in the pre-vacuum chamber in a continuous manner.

In certain embodiments, an ion guide can be used to transfer analyte ions efficiently from the orifice of the pulsed solenoid valve chamber into the mass analyzer.

In general, the pressure at the mass analyzer can be maintained below about $1\times10^{-3}$ Torr, or below about $5\times10^{-4}$ Torr, or below about $2\times10^{-4}$ Torr, or below about $1\times10^{-4}$ Torr, or below about $5\times10^{-5}$ Torr. The pressure at the mass analyzer can be maintained at $1\times10^{-5}$ Torr, or at $5\times10^{-5}$ Torr, or at $1\times10^{-4}$ Torr, or at $2\times10^{-4}$ Torr, or at $3\times10^{-4}$ Torr, or at $4\times10^{-4}$ Torr, or at $5\times10^{-4}$ Torr.

For the pumping system of the mass spectrometer, a 5 L/min diaphragm pump and 30 L/s turbo pump can be used. The mass of the diaphragm pump can be about 1 kg and the mass of the turbo pump can be about 4 kg.

In certain embodiments, the total mass of the mass spectrometer was reduced to less than about 40 kg.

Figure 2:
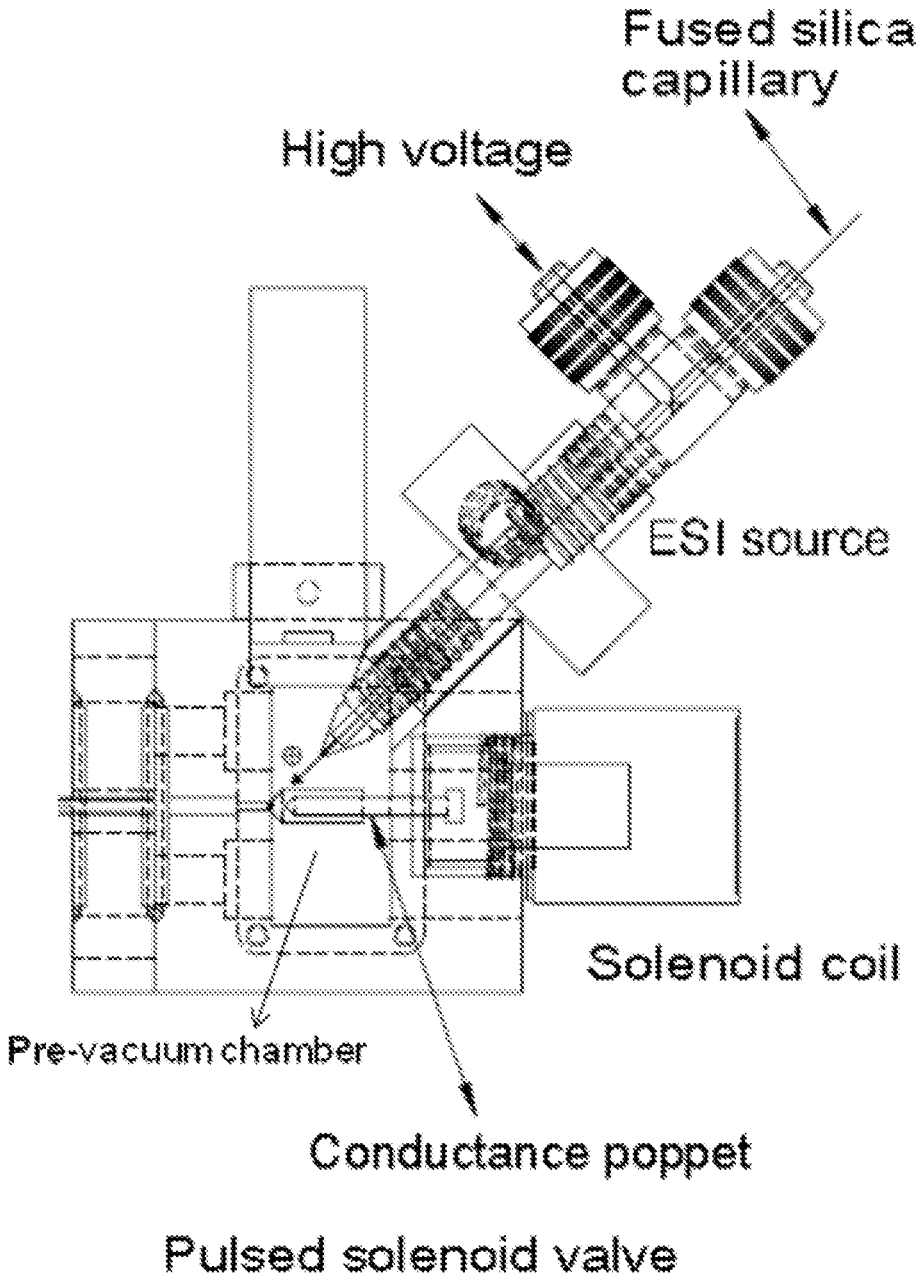
FIG. 2 shows a schematic of an embodiment of a pulsed solenoid valve apparatus for a mass spectrometer of this invention. A pre-vacuum chamber is located adjacent to a flange having an orifice. The pre-vacuum chamber is attached to a pulsed solenoid valve. A poppet of the pulsed solenoid valve reaches into the pre-vacuum chamber. The tip of the poppet can seal the orifice closed. The tip of the poppet can be formed or coated with a conductive material. Examples of a conductive material include conductive rubber, conductive plastic, and conductive gel. The poppet of the pulsed solenoid valve can be controlled electronically to open and close rapidly. The pulsed solenoid valve can have a rapid response time of less than 2 ms with high reproducibility. The pre-vacuum chamber and/or the valve can be heated. An electrospray tip of a high DC voltage electrospray ion source can be inserted directly into the interior of the pre-vacuum chamber.

FIG. 2 shows a schematic of an embodiment of a pulsed solenoid valve apparatus for a mass spectrometer of this invention. A pre-vacuum chamber is located adjacent to a flange having an orifice. The pre-vacuum chamber can be made from stainless steel. The pre-vacuum chamber can be between the flange and the pulsed solenoid valve. The tip of a high DC voltage electrospray ion source can be inserted directly into the interior of the pre-vacuum chamber. In operation, ions can be generated inside the pre-vacuum chamber of the pulsed solenoid valve.

This arrangement may advantageously allow direct injection of analyte ions from an electrospray into the high vacuum region of a mass analyzer of a mass spectrometer apparatus.

In some embodiments, the pre-vacuum chamber can be enclosed by the flange having the orifice, and the pre-vacuum chamber can be integrated with the flange, or the pulsed solenoid valve, or both.

In some embodiments, the pre-vacuum chamber can be at ambient pressure, or about one atmosphere pressure.

In certain embodiments, the pre-vacuum chamber can be evacuated to a partial pressure less than ambient, or less than one atmosphere.

The pre-vacuum chamber shown in FIG. 2 is attached to a pulsed solenoid valve. The pulsed solenoid valve can include a solenoid coil, a spring, a magnet, and a poppet.

In operation, the spring can apply force to the poppet which can reach into the pre-vacuum chamber to seal the orifice and prevent gas from leaking into the high vacuum region and mass analyzer. A voltage applied to the solenoid coil can pull back the magnet and the poppet to expose the orifice and allow gas or analytes to pass. The voltage applied to the solenoid coil can be controlled with a delay time functional generator.

The tip of the poppet can seal the orifice closed. The tip of the poppet can be formed from a conductive material. For example, the poppet can be made of a conductive rubber tip on a stainless steel rod.

In operation, the conductive tip of the poppet may prevent and eliminate the build up of electrical charges on the poppet, orifice surface, or apparatus which can block or impede the flow or transmission of gas ions through the orifice. The use of the conductive tip in a pulsed ion beam apparatus of this invention can provide a surprisingly high throughput of gas ions into the high vacuum region and mass analyzer.

In operation, when the solenoid valve is open, the conductive tip is pulled back from the orifice and analyte ions can pass through the gap between the conductive tip and the orifice and then through the orifice.

Referring to FIG. 2, the poppet of the pulsed solenoid valve can be controlled electronically to open and close rapidly. In operation, when the pre-vacuum chamber contains gas ions or analyte ions, the opening and closing of the poppet can create a pulsed ion beam through the orifice of the pre-vacuum chamber. The pulsed solenoid valve can have a rapid response time of less than 2 ms with high reproducibility.

In some embodiments, the flange is adjacent to the high vacuum region of a mass spectrometer, so that the pulsed ion beam can pass through the orifice from the pre-vacuum chamber into the high vacuum region.

In some aspects, the pulsed ion beam can be collimated by passing through the orifice of the flange.

In some embodiments, the diameter of orifice may range from 0.1 to 2.5 mm. In certain embodiments, the diameter of orifice may be 0.5 mm, or 1.0 mm.

The pre-vacuum chamber and/or the pulsed solenoid valve itself can be heated. The heating can accelerate desolvation or evaporation of the electrospray to create gas ions or analyte ions. In some embodiments, the pre-vacuum chamber and/or the pulsed solenoid valve can be heated to a temperature of up to 60° C., or up to 80° C., or up to 100° C., or up to 110° C., or up to 120° C., or up to 130° C., or higher to desolvate or evaporate the electrospray.

In operation, for the electrospray apparatus, analytes enter at ambient pressure of about one atmosphere. An electrospray is created at the tip of the electrospray apparatus inside the pre-vacuum chamber of the pulsed solenoid valve and undergoes a desolvation process. The analyte ions are delivered by the pulsed ion beam into the high vacuum region of the mass analyzer after the desolvation process.

In operation, when ions are analyzed, ion optics can be controlled to gate the entrance of ions into the ion analyzer. The advantage of this approach can be the high scan speed by electronic control.

In general, the number of analytes delivered at the electrospray tip can be more than the number of analytes that can be removed by the pumping system.

In some aspects, the throughput of analyte ions from the electrospray tip to the mass analyzer is controlled using the pulsed solenoid valve.

In operation, a neutral gas stream may pass through the orifice and into the vacuum region of the mass analyzer as a molecular beam.

In certain aspects, the ion beam can follow an air stream to enter the ion trap of a mass analyzer.

An example of a valve for which some of the components may be used to fabricate a pulsed solenoid valve of this invention includes a Parker Series 99 dispense valve (Parker Hannifin Corp).

The pulsed ion beam apparatus of this invention in combination with an electrospray source can provide advantageously reduced gas loading into the vacuum region of the mass analyzer. Because the gas loading is reduced, the pulsed ion beam apparatus of this invention can be operated with a pumping system of reduced mass. This can provide a mass spectrometer of advantageously reduced mass and size.

Referring to FIG. 1, in certain aspects, an RF frequency and voltage can be applied to the ring electrode of a quadrupole ion trap mass analyzer to trap the analyte ions. When the analyte ions match a certain qz value, they would be ejected out of the ion trap and detected by the charge amplification device such as an electron multiplier.

The mass analyzer can be an ion trap, a linear ion trap, or a quadrupole ion trap.

In some embodiments, analyte ions from more than one pulse of the pulsed solenoid valve electrospray apparatus can be trapped in the ion trap. This procedure provides mechanical signal gain which advantageously permits obtaining the mass spectrum of the analyte ions with increased sensitivity.

In operation, the number of analytes that can pass into the high vacuum region of the mass analyzer can be controlled by the duration time of the opening of the pulsed solenoid valve.

In operation, when the pulsed solenoid valve is opened, the pressure in the vacuum region may increase to about $6\times10^{-3}$ Torr.

In operation, when the pulsed solenoid valve is closed during mass analysis, the pressure in the vacuum region may be maintained below about $5\times10^{-4}$ Torr.

Figure 3:
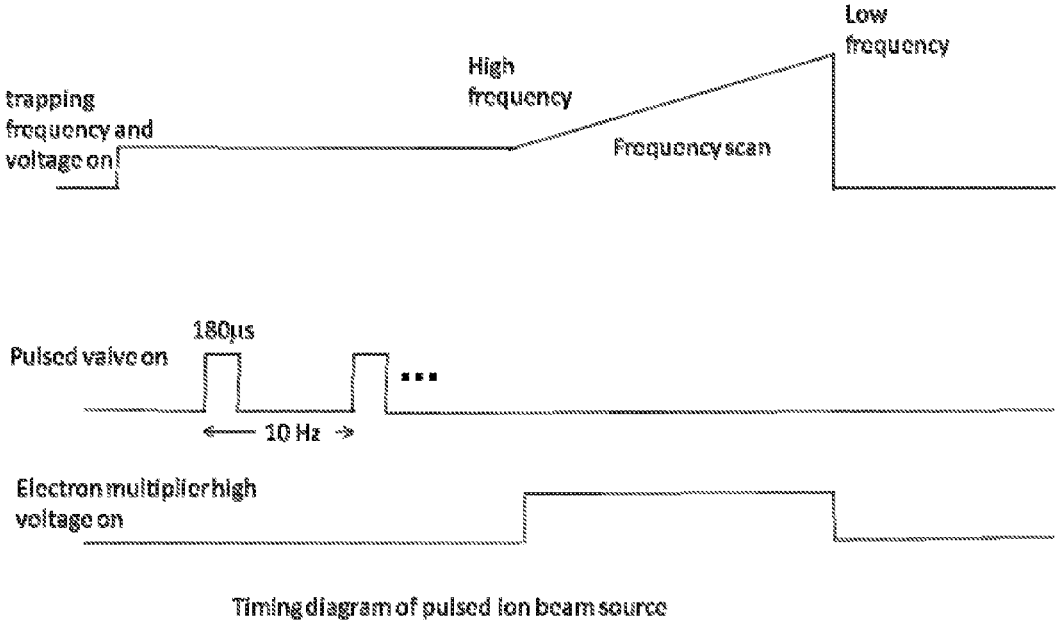
FIG. 3 shows a timing diagram for an embodiment of a pulsed solenoid valve apparatus for a mass spectrometer of this invention.

Referring to FIG. 3, in certain aspects, while a trapping voltage is being applied to the mass analyzer and the ion trapping process is active, a voltage can be applied to the pulsed solenoid valve for a duration period and at a rate to open the pulsed solenoid valve. Referring to FIG. 3, a duration of 180 μs can be used with a rate of 10 Hz.

The duration time of the opening of the pulsed solenoid valve can range from 180 μs to 1 ms. In some embodiments, the duration time of the opening of the pulsed solenoid valve can be 180 μs, or 200 μs, or 250 μs, or 300 μs, or 500 μs, or 750 μs, or 1000 μs.

In some embodiments, the pulsed solenoid valve can be opened a number of times in repetition to provide a pulsed ion beam.

In certain embodiments, the pulsed solenoid valve can be triggered at a rate of from 1 to 20 Hz, or from 1 to 15 Hz, or from 1 to 10 Hz, or from 1 to 7 Hz, or from 1 to 5 Hz. The pulsed solenoid valve can be triggered at a rate of 1 Hz, or 2 Hz, or 3 Hz, or 4 Hz, or 5 Hz, or 7 Hz, or 10 Hz, or 15 Hz, or 20 Hz.

The number of times the pulsed solenoid valve can be opened in one measurement of a mass spectrum can range from 1 to 100, or from 1 to 50, or from 1 to 10. The number of times the pulsed solenoid valve can be opened in one measurement of a mass spectrum can be 1, 2, 3, 4, 5, 6, 7, 8, 9, 10, 20, 30, 40, 50, or 100.

In certain embodiments, the pulsed solenoid valve can be opened in repetition to provide a pulsed ion beam which is continuously fed to the mass analyzer.

Referring to FIG. 3, in certain aspects, after the pulsed solenoid valve is opened, a frequency scan can be applied to the mass analyzer and the separated ions can be detected.

EXAMPLE 1

A sample of a solution of protein cytochrome c having the concentration $1\times10^{-5}$ M was prepared for delivery by syringe injection. The speed of the syringe pump was 150 μL/min, and a portion of the sample was pushed through the inner diameter of a 75 μm fused silica capillary of an electrospray apparatus. The spray tip of the electrospray apparatus was in a stainless steel chamber located at the end of a pulsed solenoid valve. A high voltage of 2500 V was applied to the electrospray tip. The valve of the pulsed solenoid valve was operated so that the maximum duration time for opening was 200 μs. The pumping system of the mass spectrometer apparatus was a 5 L/min diaphragm pump and 30 L/s turbo molecular pump. The weight of the diaphragm was about 1 kg and the weight of the turbo molecular pump with its controller board was about 4 kg.

EXAMPLE 2

Figure 4:
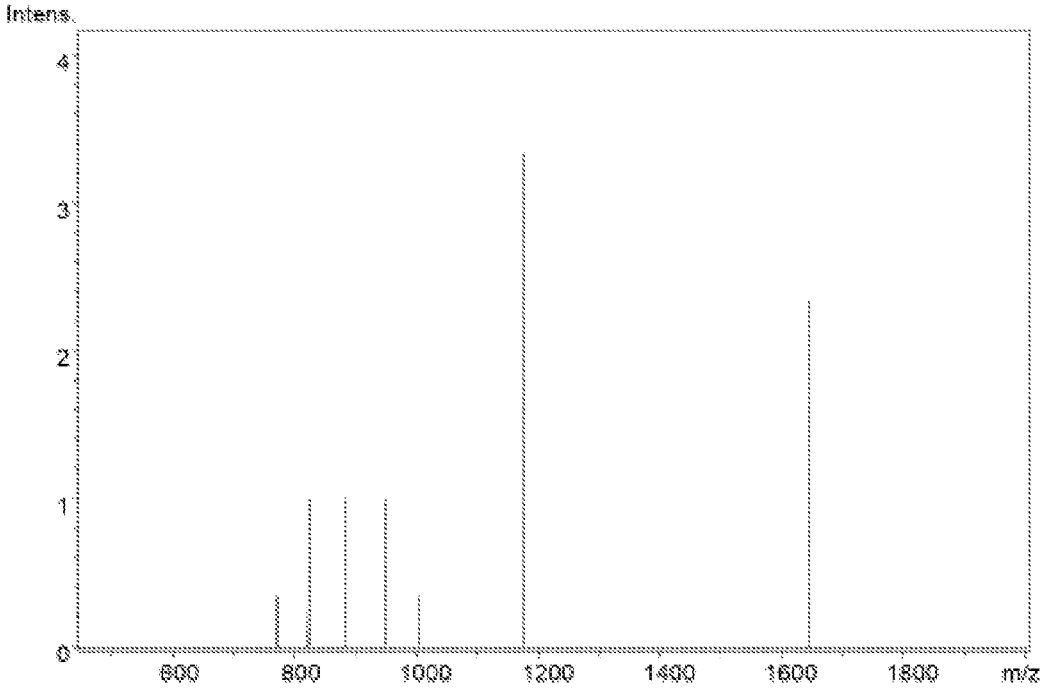
FIG. 4 shows a mass spectrum of analyte protein cytochrome c obtained with an embodiment of a pulsed ion beam mass spectrometer of this invention.

FIG. 4 shows a mass spectrum that was obtained with the apparatus and conditions of Example 1 when the pulsed solenoid valve was kept closed. FIG. 4 shows that a very low level of signal was obtained when no ions were allowed to pass through the orifice.

EXAMPLE 3

Figure 5:
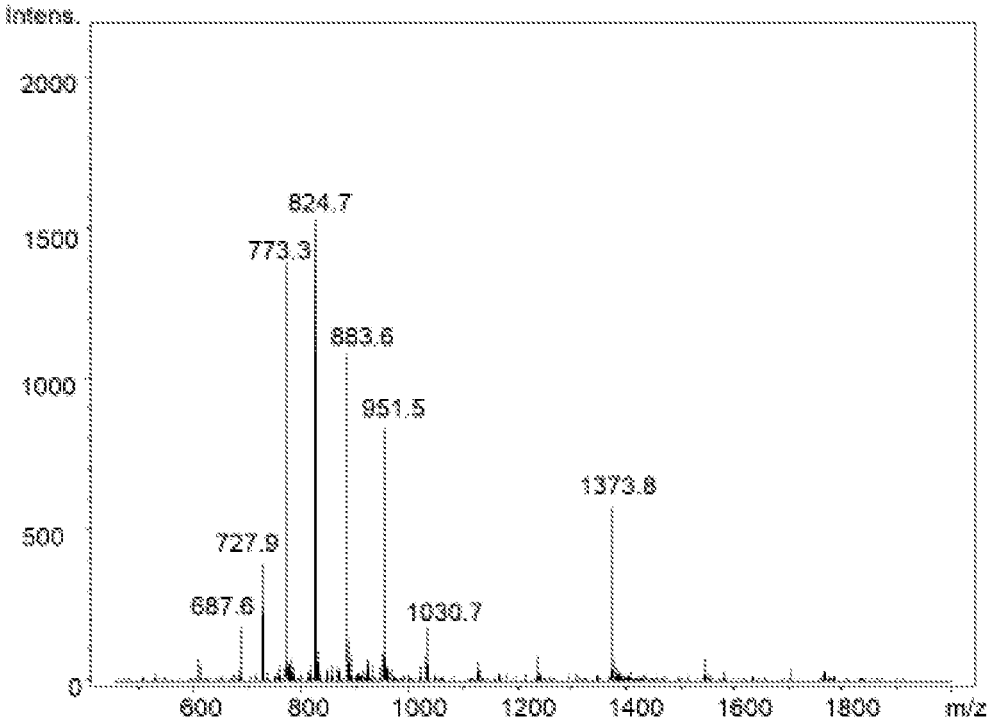
FIG. 5 shows a mass spectrum of analyte protein cytochrome c obtained with an embodiment of a pulsed ion beam mass spectrometer of this invention.

FIG. 5 shows a mass spectrum that was obtained with the apparatus and conditions of Example 1 when the pulsed solenoid valve was triggered at a rate of 1 Hz. FIG. 5 shows a baseline level of signal in the mass spectrum under these conditions.

EXAMPLE 4

Figure 6:
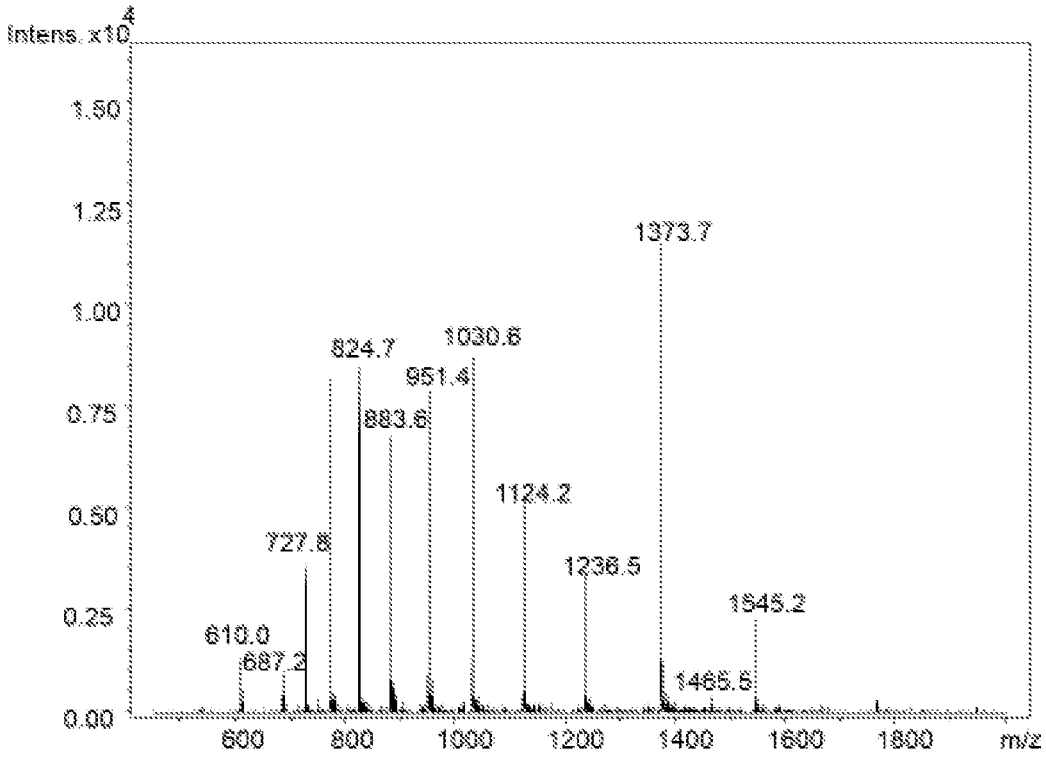
FIG. 6 shows a mass spectrum of analyte protein cytochrome c obtained with an embodiment of a pulsed ion beam mass spectrometer of this invention.

FIG. 6 shows a mass spectrum that was obtained with the apparatus and conditions of Example 1 when the pulsed solenoid valve was triggered at a rate of 10 Hz. FIG. 6 shows a level of signal in the mass spectrum that was increased by a factor of ten times over the level of signal observed in FIG. 5 when the pulsed solenoid valve was triggered at a rate of 1 Hz.

All publications and patents and literature specifically mentioned herein are incorporated by reference for all purposes.

It is understood that this invention is not limited to the particular methodology, protocols, materials, and reagents described, as these may vary. It is also to be understood that the terminology used herein is for the purpose of describing particular embodiments only, and is not intended to limit the scope of the present invention which will be encompassed by the appended claims.

It must be noted that as used herein and in the appended claims, the singular forms "a", "an", and "the" include plural reference unless the context clearly dictates otherwise. As well, the terms "a" (or "an"), "one or more" and "at least one" can be used interchangeably herein. It is also to be noted that the terms "comprises," "comprising", "containing," "including", and "having" can be used interchangeably.

Without further elaboration, it is believed that one skilled in the art can, based on the above description, utilize the present invention to its fullest extent. The following specific embodiments are, therefore, to be construed as merely illustrative, and not limitative of the remainder of the disclosure in any way whatsoever.

All of the features disclosed in this specification may be combined in any combination. Each feature disclosed in this specification may be replaced by an alternative feature serving the same, equivalent, or similar purpose.

What is claimed is:

1. A method for obtaining a mass spectrum, the method comprising:

providing analyte ions from an electrospray tip in a pre-vacuum chamber having an orifice;

operating a pulsed solenoid valve attached to the pre-vacuum chamber by opening and closing the orifice with a conductive tip of a poppet of the pulsed solenoid valve, thereby providing a pulsed analyte ion beam comprising pulses of analyte ions exiting the pre-vacuum chamber through the orifice and entering a high vacuum region containing a mass analyzer, wherein when the orifice is opened the pre-vacuum chamber is in fluid communication with the high vacuum region and the build up of electrical charges on the poppet and orifice are avoided;

operating the mass analyzer to collect the analyte ions in the pulsed analyte ion beam and separate the analyte ions by their mass to charge ratio;

detecting the separated analyte ions.

2. The method of claim 1, wherein more than one pulse of the pulsed analyte ion beam is collected and separated by the mass analyzer.

3. The method of claim 1, wherein the duration of the pulsed analyte ion beam is controlled by using a delay time function generator.

4. The method of claim 1, wherein the analyte ions are formed from nonvolatile, thermally-labile organic molecules or biomolecules.

5. The method of claim 1, further comprising heating the pre-vacuum chamber to a temperature of up to 130° C.

6. The method of claim 1, further comprising heating the pre-vacuum chamber to a temperature of up to 105° C.

7. A mass spectrometer apparatus comprising:

a high vacuum region containing a mass analyzer, wherein the pressure in the high vacuum region is maintained by pumps;

a pre-vacuum chamber having an orifice formed by a wall of the pre-vacuum chamber;

an electrospray tip in the pre-vacuum chamber;

a pulsed solenoid valve attached to the pre-vacuum chamber that seals the orifice when the valve is closed, wherein the orifice provides fluid communication between the pre-vacuum chamber and the high vacuum region when the pulsed solenoid valve is opened;

a detector.

8. The apparatus of claim 7, wherein the pulsed solenoid valve has a poppet with a conductive tip, wherein the tip of the poppet is arranged to close the orifice.

9. The apparatus of claim 8, wherein the conductive tip is formed from a conductive rubber or conductive plastic.

10. The apparatus of claim 7, wherein the pulsed solenoid valve has a response time of less than 2 ms.

11. The apparatus of claim 7, wherein the wall of the pre-vacuum chamber containing the orifice is integrated with the mass analyzer.

12. The apparatus of claim 7, wherein the mass analyzer is an ion trap.

13. The apparatus of claim 7, wherein the mass analyzer is a quadrupole ion trap.

14. The apparatus of claim 7, wherein the duration of the pulsed ion beam is controlled by using a delay time function generator.

15. The apparatus of claim 7, wherein the mass of the pumps is less than about 6 kg.

16. The apparatus of claim 7, wherein the mass of the apparatus is less than 40 kg.

17. An apparatus for creating a pulsed ion beam, the apparatus comprising:

a pre-vacuum chamber;

an orifice formed by a wall of the pre-vacuum chamber;

a pulsed solenoid valve attached to the pre-vacuum chamber;

a poppet of the pulsed solenoid valve having a tip, wherein the tip of the poppet is formed of conductive rubber and seals the orifice when the valve is closed, and wherein the pulsed solenoid valve can be opened by pulling the poppet back from the orifice.

18. The apparatus of claim 17, wherein the pulsed solenoid valve has a response time of less than 2 ms.

19. The apparatus of claim 17, wherein the duration of the pulsed ion beam is controlled by a delay time function generator to operate the pulsed solenoid valve.

20. The apparatus of claim 17, wherein the pre-vacuum chamber is heated.

* * * * *